US007051480B1

(12) United States Patent
Dennis

(10) Patent No.: US 7,051,480 B1
(45) Date of Patent: May 30, 2006

(54) APPARATUS AND SYSTEM FOR PREVENTING ICE DAM FORMATION

(76) Inventor: William D. Dennis, 1111 Winthrop Dr., Troy, MI (US) 48083

( * ) Notice: Subject to any disclaimer, the term of this patent is extended or adjusted under 35 U.S.C. 154(b) by 0 days.

(21) Appl. No.: 11/035,941

(22) Filed: Jan. 13, 2005

(51) Int. Cl.
*E04D 13/076* (2006.01)

(52) U.S. Cl. ..... 52/24; 52/11; 52/12; 52/16; 52/24; 52/217

(58) Field of Classification Search ..... 52/11, 52/12, 16, 24
See application file for complete search history.

(56) References Cited

U.S. PATENT DOCUMENTS

| | | | | |
|---|---|---|---|---|
| 3,184,890 | A | 5/1965 | McKey | |
| 4,041,656 | A * | 8/1977 | Anderson | 52/16 |
| 4,608,277 | A | 8/1986 | Greiner et al. | |
| 4,763,450 | A * | 8/1988 | Daniel | 52/24 |
| 5,107,635 | A * | 4/1992 | Carpenter | 52/12 |
| 5,746,027 | A | 5/1998 | Bonerb | |
| 5,820,762 | A * | 10/1998 | Bamer et al. | 210/661 |
| 5,890,324 | A | 4/1999 | Maanum | |
| 6,225,600 | B1 | 5/2001 | Burris | |
| 6,282,846 | B1 | 9/2001 | Nocella | |
| 6,308,464 | B1 * | 10/2001 | Demartini | 52/16 |
| 6,484,453 | B1 * | 11/2002 | Nocella | 52/24 |
| 6,668,491 | B1 | 12/2003 | Bonerb | |
| 6,694,678 | B1 | 2/2004 | Schneider | |
| 6,700,098 | B1 | 3/2004 | Wyatt et al. | |
| 6,772,543 | B1 * | 8/2004 | Kassouni | 37/227 |

* cited by examiner

*Primary Examiner*—Carl D. Friedman
*Assistant Examiner*—Abdul Manaf
(74) *Attorney, Agent, or Firm*—Meroni & Meroni, P.C.; Charles F. Meroni, Jr.; Christopher J. Scott

(57) ABSTRACT

Disclosed is an apparatus for eliminating ice formation at roof edging comprising a mesh casing and salt-based fill material. The apparatus may be placed into a typical gutter assembly adjacent a roof edge. The casing is flexible and biodegradable and comprises a salt-retaining surface, a matter-engaging surface, and a plurality of mesh apertures. The mesh apertures each comprise a maximal aperture dimension. The fill material comprises a plurality of salt pellets, each pellet comprising a minimal pellet dimension. The minimal pellet dimension is greater in magnitude than the maximal aperture dimension and thus the fill material is retained by the salt-retaining surface. A portion of the fill material dissolves in water when water contacts the fill material thus forming a flowable solution. The solution inherently has a depressed freezing point for preventing ice formation. Thus, the water-based solution flowing from the apparatus functions to eliminate ice at roof edging.

15 Claims, 3 Drawing Sheets

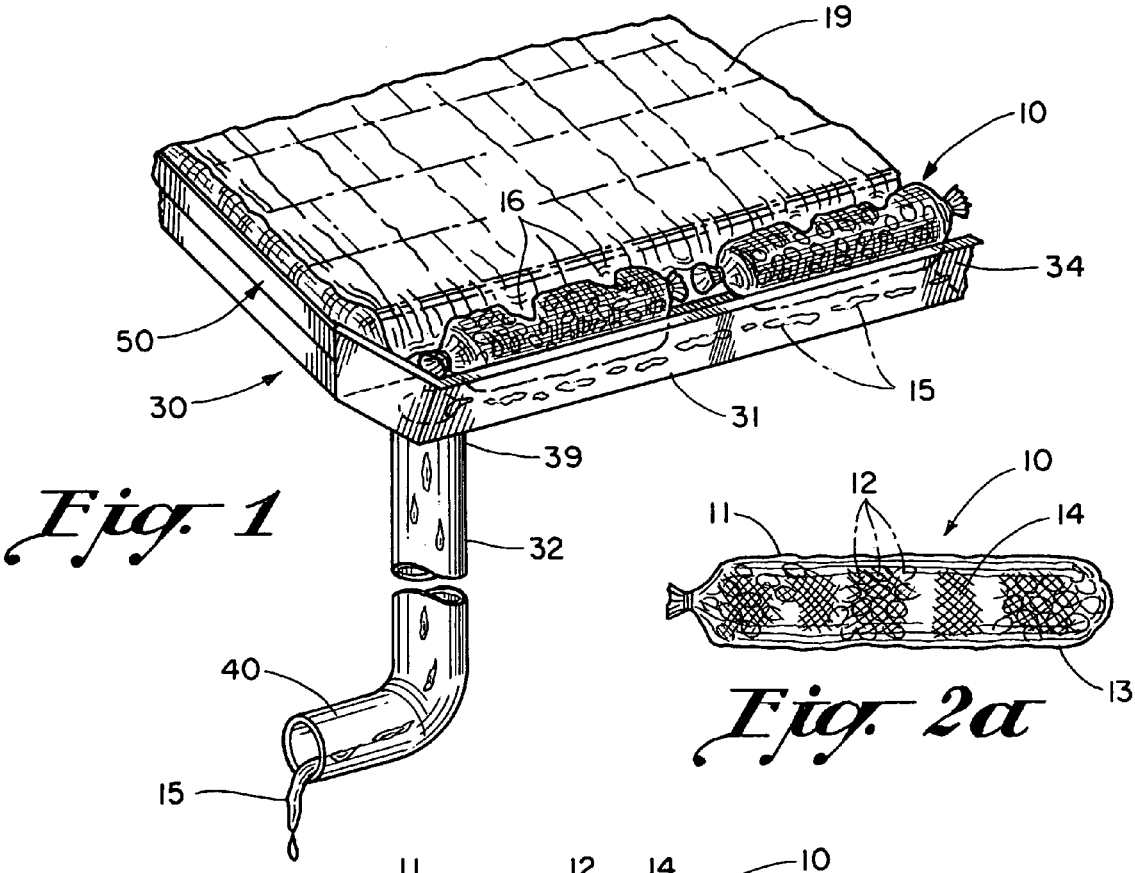
Fig. 1
Fig. 2a
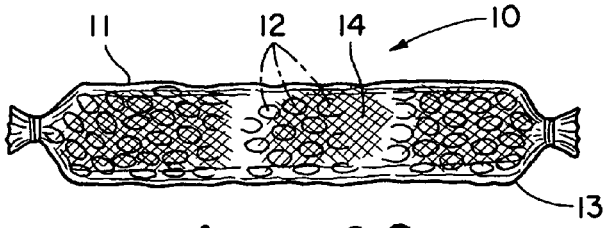
Fig. 2b
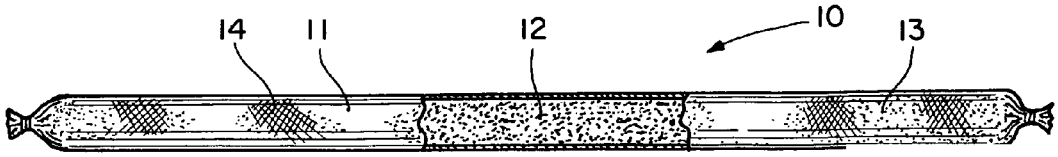
Fig. 2c

APPARATUS AND SYSTEM FOR PREVENTING ICE DAM FORMATION

BACKGROUND OF THE INVENTION

1. Field of the Invention

The present invention generally relates to a system for deicing roof edges equipped with gutter and downspout assemblies. More particularly, the present invention relates to an apparatus for placement in gutter systems mounted in adjacency to roof edging for preventing the formation of ice dams at the roof edging and for maintaining the roof edging, outfitted with a gutter assemblage, in an ice-free state.

2. Description of the Prior Art

Building structures located in regions having significant snowfall experience any of a number of problems associated with large amounts of snowfall. For example, over time, roof-bound snow tends to accumulate moisture, which can lead to damaging structural strain. Furthermore, the buildup of moisture in roof-bound snow can often lead to the formation of ice dams. Ice dams, in turn, can cause water to migrate into interior walls and ceilings thus causing significant damage to interior structures, including plaster, paint, wallpaper, wiring, etc. The repair of structural damage resulting from ice dam formation and the like can often result in substantial repair costs.

There is a complex interaction among the amount of heat loss from a building structure, snow cover, and outside temperatures that leads to ice dam formation. For ice dams to form there must be snow on the roof, and, at the same time, higher portions of the roof's outside surface must be above 32° F. on average while lower surfaces are below 32° Fahrenheit (F) on average. For a portion of the roof to be below 32° F., outside temperatures must also be below 32° F. The snow on a roof surface at temperatures above 32° F. will melt. As water from the melting snow flows down the roof it reaches the portion of the roof that is at a temperature below 32° F. and freezes. Thus, it will be understood that an ice dam is likely to form at roof edging.

The ice dam increases in size as it is fed by the melting snow above it, but it will limit itself to the portions of the roof that are at a temperature that is, on average, below 32° F. When water above the dam backs up behind the formed ice dam, it often remains liquid and thus enters into the building structure via cracks and openings in the exterior roof covering. Since most ice dams form at the edge of the roof, it is evident that a heat source warms the roof in areas other than at the roof edge. The noted heat source is primarily the building structure itself, although it should be noted that in rare instances solar heat gain may cause the noted temperature differences.

Heat from the building structure travels to the roof surface in three primary ways, namely, conduction, convection, and radiation. Conduction is the term given to the transfer of heat energy through a solid; convection is the term given to the transfer of heat energy via air currents formed as heated air rises and cooler air sinks; and radiation is the term given to the transfer of heat energy via electromagnetic wave energy. In a building structure, heat is transferred through the ceiling and insulation by conduction through the slanted portion of the ceiling. In many building structures there is little space in regions like this for insulation, so it is important to use an insulative material with a high R-value per inch to reduce heat loss by conduction. The top surface of the insulation is warmer than the other surroundings in the attic. Therefore, the air just above the insulation is heated and rises, carrying heat by convection to the roof. The higher temperatures in the insulation's top surface compared to the roof sheathing transfers heat outward by radiation. These two modes of heat transfer can be reduced by adding insulative materials. The addition of insulative materials will make the top surface temperature of the insulation closer to surrounding attic temperatures directly affecting convection and radiation from this surface.

There is another type of convection that transfers heat to the attic space and warms the roof, namely by air leakage. In many building structures this is the major mode of heat transfer that leads to the formation of ice dams. Exhaust systems like those commonly found in kitchens or bathrooms that terminate just above the roof may also contribute to snow melting. These exhaust systems may have to be moved or extended in building structures located in regions that receive significant amounts of snow fall. Other sources of heat in the attic space include chimneys. Frequent use of wood stoves and fireplaces allow heat to be transferred from the chimney into the attic space.

Inadequately insulated or leaky duct work in the attic space will also be a source of heat. Thus, improving insulation values and repairing these areas are well within any plan to limit or reduce the likelihood of ice dam formation. However, these methods of preventing and/or eliminating ice dam formation tend to be prohibitively expensive for many home and building owners. Thus, less costly means for preventing and/or eliminating ice dam formation become more attractive to owners of building structures desirous of keeping their building structures in a well-maintained state.

One means to prevent and/or eliminate ice formation is to apply a chemically-active compound (most often salt) to the frozen water thereby depressing the freezing point of the frozen water and melting the ice. Many types of chemical ice melters are used on streets, driveways, parking lots, and sidewalks, some of which are described hereinafter.

Halite (rock salt) is the most common ice melting salt. Halite is mined throughout the world. The primary chemical in rock salt is sodium chloride (NaCl). Halite is usually medium to dark gray in color if mined from shaft or pit mines. Purer forms of sodium chloride can be solution mined (forcing water into an underground salt dome and evaporating the brine that is forced out to recover the dissolved salt), but these methods are rather expensive for ice melting. Calcium chloride ($CaCl_2$) and magnesium chloride ($MgCl_2$) can be manufactured or evaporated from naturally occurring brines like the Great Salt Lake in Utah. Both chlorides release heat (are exothermic) as they dissolve, which helps it melt ice at very low temperatures. Further features and advantages of calcium chloride, in particular, are described in more detail hereinafter in the section entitled, Detailed Description of the Preferred Embodiment.

Ammonium Sulphate ($[NH_4]_2SO_4$) is a fertilizer ingredient that is infrequently used in ice melting salts. Potassium chloride (KCl, potash) commonly takes the form of red or white granules. The red grade comes from traditional shaft mines and gets it's color from iron contamination. The pure white grade is solution mined. Potassium chloride is not as effective at very low temperatures, making pure potassium chloride impractical unless used in conjunction with other ingredients. Urea is another compound utilized for melting ice. In its pure form, urea is not corrosive making it a good choice for use around corrosion-sensitive machinery, such as airplanes. In this regard, it is noted that urea must meet strict contamination regulations before being approved to use at airports.

Ethylene glycol is a liquid deicer. It is commonly mixed with liquid urea and applied using bulk sprayers and tanker trucks and is applied primarily at airports. Potassium acetate is a biodegradable liquid deicer. It is also primarily used for deicing purposes at airports. Because potassium acetate is corrosive it is often mixed with a corrosion inhibitor. Calcium magnesium acetate (CMA) was developed as an environmentally responsible alternative to road salt. While CMA is one of the safest of all ice melting chemicals, it also has a high cost and thus the practicality of using CMA is limited. Further, CMA is not effective at very low temperatures. Alpha methyl glucoside (MG-104) is a corn by-product that is most effective when combined with other ingredients. MG-104 provides a catalytic affect that speeds melting, helps other chemicals to work at lower temperatures, and assists in the extension of freeze-thaw cycles to reduce surface damage.

When ice and water are placed in contact with one another at an ice-water interface, molecules on the surface of the ice escape into the water (melting), and molecules of water are captured on the surface of the ice (freezing). When the rate of freezing is the same as the rate of melting, the amount of ice and the amount of water will not change on average (although there are short-term fluctuations at the surface of the ice). The ice and water are then said to be in dynamic equilibrium with each other. The balance between freezing and melting can be maintained at 0° Celsius (C) or 32° F. unless conditions change in a way that favors one of the processes over the other.

The balance between freezing and melting processes can easily be upset. If the ice/water mixture is cooled, the molecules move slower. The slower-moving molecules are more easily captured by the ice, and freezing occurs at a greater rate than melting. Conversely, heating the mixture makes the molecules move faster on average, and thus, melting is favored.

Adding salt (or other chemically active compounds such as those hereinabove described) to the system will also disrupt the equilibrium. Consider replacing some of the water molecules with molecules of some other substance. The foreign molecules dissolve in the water, but do not pack easily into the array of molecules in the solid. Notably, there are fewer water molecules on the liquid side because the some of the water has been replaced by salt. The total number of waters captured by the ice per second goes down, so the rate of freezing goes down. The rate of melting is unchanged by the presence of the foreign material, so melting occurs faster than freezing.

To re-establish equilibrium, one must cool the ice-salt-water solution (or chemical-water solution) to below the usual melting point of water. For example, the freezing point of a 1 M NaCl solution is roughly −3.4° C. Solutions will always have such a freezing point depression or depressed freezing point. Generally, the higher the concentration of salt or chemically-active compound, the greater the freezing point depression. For every mole of foreign particles dissolved in a kilogram of water, the freezing point goes down by roughly 1.7°–1.9° C. Sugars and alcohols, for example, will also lower the freezing point and melt the ice. Salt is most often used as an ice-melting agent (e.g. on roads and walkways) because it is inexpensive and readily available.

It is important to realize that freezing point depression or a depressed freezing point occurs because the concentration of water molecules in a solution is less than the concentration in pure water. The nature of the solute does not matter. One might expect that solutes with large molecules are better at blocking water molecules traveling towards the surface of the ice. The hypothesis that solutes with large molecules cause a larger freezing point depression than those with smaller molecules is not in accord with experimental data.

As ice begins to freeze out of the salt water, the fraction of water in the solution becomes lower and the freezing point drops further. This does not continue indefinitely, because eventually the solution will become saturated with salt. The lowest temperature possible for liquid salt solution is −21.1° C. At that temperature, the salt begins to crystallize out of solution (as $NaCl.2\ H_2O$, for example), along with the ice, until the solution completely freezes. The frozen solution is a mixture of separate $NaCl.2H_2O$ crystals and ice crystals, not a homogeneous mixture of salt and water. This heterogeneous mixture is called a eutectic mixture.

Thus, it will be understood that ice and snow melting chemistry is straightforward, progressing based on the colligative property known as freezing point depression. Colligative means that the property depends only on the number of particles present, and not on chemical properties of the particles. Typically, a chemical is chosen that dissolves in water easily and quickly, dissociates into ions, and is safe for application. All ice melting salts dissociate into ions as they dissolve into the melting ice and snow. This multiplies the molar quantity, and multiplies the effect of freezing point depression. Rock salt for instance, releases a ratio of one sodium ion (Na+) to one chloride ion (Cl−) for twice the effect. Calcium chloride releases one calcium ion (Ca+) for every two chloride ions for three times the effect.

Thus, the notion developed that use of a chemically-active compound (preferably salt) may be used to prevent and/or eliminate ice formation at roof edging. Some of the more pertinent prior art relating to the prevention of and/or elimination of ice formation at roof edging is described briefly hereinafter. Notably, some of the prior art briefly described hereinafter does not teach the application of chemical ice-melting agents to roof edging, but the prior art is cited as being generally relevant to the state of art relating to prevention and/or elimination of ice formation at roof edging.

U.S. Pat. No. 6,225,600 ('600 patent), which issued to Burris, discloses a Snow Melting Device for Gutters. The '600 patent teaches a snow melting device comprising an elongate strip member encasing a heating coil, which encased heating coil is positionable within a closed lower end of a gutter. Upon activation, the heating coil serves to melt snow accumulated in or about the gutter to allow proper drainage of water through the downspouts of the gutter assemblage.

U.S. Pat. No. 6,282,846 ('846 patent), which issued to Nocella, discloses a Roof Drain De-Icer Apparatus. The '846 patent teaches a sleeve-like container fabricated from a waterproof material, comprising an upper and lower surface with a hollow interior filled with rock salt. At least a portion of the lower surface is perforated with a plurality of openings and is positioned with the lower perforated surface in contact with the upper surface of a flat, sloped roof to provide wicking absorption of water flowing down the roof into the salt. Absorption of water by the salt leads to release of the resulting saline solution through the perforated openings to the surface of the roof, preventing formation of ice on the roof downstream of the plastic sleeve and in the roof drain. The waterproof container with the packed salt is secured to the surface of the roof by an adhesive tape, or a weight attached to or lying upon opposite ends of the container.

U.S. Pat. No. 6,484,456 ('453 patent), which issued to Nocella, discloses a Roof Drain De-Icer Apparatus and Method. The '453 patent teaches a de-icer formed of a solid block of a pressed, granulated salt comprising at least a top portion water-proofed to prevent rapid deterioration due to precipitation. An exposed bottom surface is in contact with the upper surface of a flat, sloped roof to provide wicking absorption of water flowing down the roof into the salt. Absorption of water by the salt leads to release of the resulting saline solution to the surface of the roof, preventing formation of ice on the roof downstream of the de-icer and in the roof drain. The de-icer may be maintained in place on the surface of the roof by an adhesive tape, or by its own weight.

U.S. Pat. No. 6,694,678 ('678 patent), which issued to Schneider, discloses an Apparatus and Methodology for Limiting Ice Build-Up. The '678 patent teaches an apparatus for limiting ice build-up in a gutter, the apparatus deployable in a gutter which has a bottom, the apparatus comprising sidewalls and a base comprising a top side, the sidewalls joined to the top side of the base with the side walls defining a salt block opening through which the salt block is loadable into the housing, with one of the side walls defining a flow opening for allowing frozen precipitation to pass therethrough and contact the salt block and melt.

U.S. Pat. No. 6,700,098 ('098 patent), which issued to Wyatt et at., discloses a System for Preventing and Clearing Ice Dams. The '098 patent teaches a system comprising a plurality of wire holding assemblies, each of which has a base for attachment to a gutter and length-adjustable arm for contact with a roof adjacent the gutter. The arm is rotatably and pivotally mounted to the base. The system includes a PTCR heating cable that is held in a desired position by the wire holding assembly arms. The system includes roof and gutter temperature sensors and a moisture sensor. The heating cable is connected to the control unit, the control having a mode selector switch for controlling operation of the cable.

From an inspection of these patent disclosures and other art generally known in the relevant art, it will be seen that certain obstacles become evident when one considers how to most effectively apply ice-melting salts or other chemically-active compounds to roof edging so as to prevent and/or eliminate ice dam formation, such as may be seen, for example, from the '453; '846; and '678 patents. It will be seen from an inspection of the noted disclosures, for example, that the devices utilized for salt-delivery are removably affixed to the roof edging or gutter system and comprise structures that do not readily remove themselves or self-destruct at the end of a winter season. In other words, the salt-delivery devices are not environmentally disposable but require active user participation for removal or clean up at the end of an ice dam or winter season.

Thus, it will be seen that the prior art does not teach a chemical-delivery assembly for removing ice at a roof edge, which chemical-delivery assembly comprises a flexible, biodegradable mesh casing and a solid, chemically-active fill material, which assembly may be positioned or placed in superior adjacency to a trough portion of a gutter assembly attached to a roof edge. In this regard, it will be further seen that the prior art does not teach a flexible, biodegradable mesh casing comprising an inner matter-retaining surface, an outer matter-engaging surface, a casing thickness, and a plurality of mesh apertures for effectively delivering the chemically-active fill material to the areas in and around the trough portion of a gutter assembly for maintaining the trough portion in an ice free state and/or for eliminating ice from the areas in and around the trough portion of a gutter assembly. Further, the prior art does not teach a flexible, biodegradable mesh casing comprising a biodegradable fabric having inherent seasonal durability, the inherent seasonal durability for self-destructing the mesh casing when the chemically-active fill material has decremented to substantially zero at the end of an ice dam season, the self-destructed mesh casing being removable by flowing water and thus being environmentally disposable.

SUMMARY OF THE INVENTION

It is a primary object of the present invention to provide a low cost, easily installable apparatus or system for preventing and/or eliminating the formation of ice at roof edging. It is a further object of the present invention to provide a de-icing apparatus or assembly that is self-cleaning or otherwise environmentally disposable. In this regard, it is an object of the present invention to provide a chemical-delivery assembly comprising an eco-friendly, biodegradable sheath that dissolves over time thus eliminating the need for clean-up and/or removal of the sheath or casing following chemical-delivery. It is a further object of the present invention to provide a chemical-delivery assembly that eliminates the need for adhesives, weights, and/or other fastening means to keep the assembly in functional placement at a roof edging.

To achieve these and other readily apparent objectives, the present invention provides a gutter-salt system for preventing ice dam formation at a roof edging, the gutter-salt system comprising, in combination a gutter assembly for attachment in adjacency to roof edging and a plurality of salt-delivery assemblies. The gutter assembly essentially comprises a gutter trough portion and at least one downspout portion. The gutter trough portion comprises a rear wall, a forward wall, a superior gutter end, and an inferior gutter end. The inferior gutter end comprises a substantially planar assembly-supporting surface and at least one water outlet aperture. The assembly-supporting surface extends from the rear wall to the forward wall and thus has an assembly-supporting width. The downspout portion comprises a matter inlet end, a matter outlet end, and a conduit length intermediate the matter inlet end and the matter outlet end. The matter inlet end is cooperatively associated with the matter outlet aperture for channeling matter from the assembly-supporting surface to the matter outlet end via the conduit length.

Each salt-delivery assembly essentially comprises a flexible, substantially tubular mesh casing and solid, salt-based fill material (preferably calcium chloride). The flexible, biodegradable mesh casing comprises an inner salt-retaining surface, an outer matter-engaging surface, a casing thickness, a casing length, a substantially uniform casing diameter, and a plurality of mesh apertures. The mesh casing is flexible for enabling a user to form at least one casing bend intermediate the casing length. The casing thickness and the mesh apertures extend from the salt-retaining surface to the matter-engaging surface. The casing diameter is substantially equal to or less than the assembly-supporting width. The mesh apertures each comprise a maximal aperture dimension on the order of up to about 5000 microns. The salt-based fill material comprises a plurality of salt pellets, each pellet comprising a minimal pellet dimension. The minimal pellet dimension is greater in magnitude than the maximal aperture dimension and thus the salt-based fill material is retained by the salt-retaining surface. The mesh apertures, the casing thickness, and the matter-engaging surface allow water to contact the salt-based fill material at a salt-water interface.

Each salt-delivery assembly is designed for placement in superior adjacency to the assembly-supporting surface. A salt portion of the salt-based fill material dissolves in water when water contacts the salt-based fill material thus forming a flowable salt solution. The salt solution inherently has a depressed freezing point for preventing ice formation. The salt-based fill material is decremented by an amount substantially equal to the salt portion each time water contacts the salt-based fill material. The flowable salt solution flows from the salt-water interface to the assembly-supporting surface to the matter outlet end via the matter outlet aperture, the matter inlet end, and the conduit length. The salt solution thus functions to prevent ice formation and the gutter-salt system thus prevents ice dam formation at the roof edging.

The mesh casing comprises biodegradable fabric having inherent seasonal durability for self-destructing the mesh casing when the salt-based fill material has decremented to substantially zero. The self-destructed mesh casing is movable or removable by the action of flowing water. Flowing water may thus function to move the self-destructed mesh casing from the assembly-supporting surface to the matter outlet end via the matter outlet aperture, the matter inlet end, and the conduit length. Thus, the self-destructed mesh casing is environmentally-disposable.

Each salt-delivery assembly may be placed in a select functional zone in superior adjacency to the assembly-supporting surface. The select functional zone is selected from the group consisting of an ice dam prevention zone and an ice dam elimination zone. The ice dam prevention zone is essentially defined by direct placement of the salt-delivery assembly upon the assembly-supporting surface and the ice dam elimination zone is essentially defined by direct placement of the salt-delivery assembly in superior adjacency upon an ice dam or ice formation formed directly upon the assembly-supporting surface.

Other objects of the present invention, as well as particular features, elements, and advantages thereof, will be elucidated in, or apparent from, the following description and the accompanying drawing figures.

BRIEF DESCRIPTION OF THE DRAWINGS

Other features of my invention will become more evident from a consideration of the following brief description of patent drawings, as follows:

FIG. 1 is a fragmentary perspective view of the gutter-salt system depicting a gutter assembly attached to roof edging supporting two salt-delivery assemblies.

FIG. 2(*a*) is a side view of a first embodiment of a salt-delivery assembly depicting a mesh casing having a fill end and a closed end opposite the fill end, the fill end being tied shut for retaining large dimension fill material inside the mesh casing.

FIG. 2(*b*) is a side view of a second embodiment of a salt-delivery assembly depicting a mesh casing having a first fill end and a second fill end opposite the first fill end, each fill end being tied shut for retaining large dimension fill material inside the mesh casing.

FIG. 2(*c*) is a side view of a third embodiment of a salt-delivery assembly depicting a mesh casing with parts broken away to show small dimension fill material having a first fill end and a second fill end opposite the first fill end, each fill end being tied shut for retaining the small dimension fill material inside the mesh casing.

DETAILED DESCRIPTION OF THE PREFERRED EMBODIMENT

Figure 3:
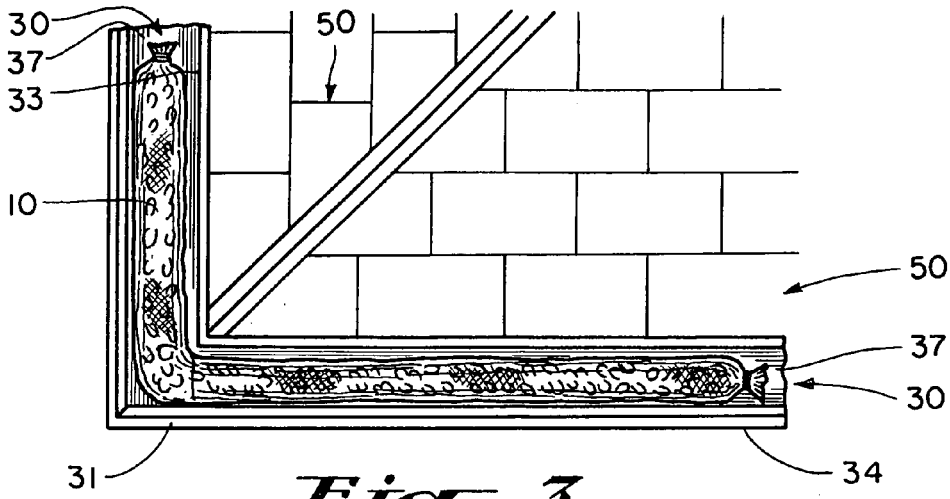
FIG. 3 is a fragmentary top plan view of the gutter-salt system depicting an elongate second embodiment of the salt-delivery assembly placed in superior adjacency to the assembly-supporting surface of the gutter assembly affixed in adjacency to roof edging, the salt-delivery assembly having a bend intermediate the length thereof.

Referring now to the drawings, the preferred embodiment of the present invention specifically concerns a gutter-salt system for preventing and/or eliminating ice dam formation. More generally, the present invention concerns a chemical-delivery system for preventing and/or eliminating ice formation(s) at roof edging comprising gutter assemblies. An ice dam or, more generally, an ice/snow formation has been referenced at 19 in FIG. 1, and 4–7. The preferred gutter-salt system or de-icing system comprises, in combination, a gutter assembly 30 for attachment in adjacency to roof edging 50 and a plurality of salt-delivery assemblies 10 all as generally illustrated and referenced in FIGS. 1, 3–6, and 7. Gutter assembly 30 and roof edging 50 are each further generally illustrated and referenced in FIG. 8. Salt-delivery assembly 10 is further generally illustrated and referenced in FIGS. 2(*a*)–2(*c*).

Gutter assembly 30 preferably comprises a gutter trough portion 31 as illustrated and referenced in FIG. 1, and 3–8, and at least one downspout portion 32 as illustrated and referenced in FIG. 1, and 4–7. Gutter trough portion 31 preferably comprises a rear wall 33 as illustrated and referenced in FIGS. 3–8; a forward wall 34 as illustrated and referenced in FIG. 1, and 3–8; a superior gutter end 35 as illustrated and referenced in FIGS. 4–7; and an inferior gutter end 36 as illustrated and referenced in FIGS. 4–7. Inferior gutter end 36 preferably comprises a substantially planar assembly-supporting surface 37 as illustrated and referenced in FIGS. 3–8; and at least one water outlet aperture 38 as illustrated and referenced in FIG. 8. It will be understood from an inspection of the noted figures that assembly-supporting surface 37 extends from rear wall 33 to forward wall 34 and thus inherently has an assembly-supporting width. Preferably the assembly-supporting width is substantially uniform as is generally depicted in FIG. 1, and 3–8.

Downspout portion 32 preferably comprises a matter inlet end 39 as illustrated and referenced in FIG. 1, and 4–7; a matter outlet end 40 as illustrated and referenced in FIG. 1; and a conduit length as generally referenced at 41 in FIG. 1. It will be understood from an inspection of FIG. 1 that conduit length 41 is intermediate matter inlet end 39 and matter outlet end 40 extending therebetween. It will be further understood that matter inlet end 39 is cooperatively associated with matter outlet aperture 38 for channeling matter (primarily water and/or debris) from assembly-supporting surface 37 to matter outlet end 40 via conduit length 41. Preferably, matter inlet end 39 is fixedly attached to an inferior surface of gutter trough portion 31 adjacent matter outlet aperture 38 for receiving and channeling matter from assembly-supporting surface 37 to matter outlet end 40 via conduit length 41.

Each salt-delivery assembly 10 preferably comprises a substantially tubular mesh casing 11 as generally illustrated and referenced in FIGS. 2(*a*)–2(*c*); and solid, chemically-active, salt-based fill material 12 as also generally illustrated and referenced in FIGS. 2(*a*)–2(*c*). Mesh casing 11 is preferably constructed from water-permeable, environmentally degradable (in other words degradable under the influence of environmental elements) or biodegradable fabric such as, but not limited to, burlap, cotton, organic cotton, hemp, jute, monofilament and multifilament polyester, or coir geo mesh. It is further contemplated that mesh casing 11 may alternatively be constructed from environmentally degradable or biodegradable, paper-based materials.

While the preferred material utilized in construction of mesh casing 11 is some fully biodegradable material, it is further contemplated that other less biodegradable materials may function with excellent results. In this regard, nylon hosiery type fabrics, when utilized as mesh casing 11, provide a sound salt-delivery casing, which properly delivers ice-melting chemical-based or salt-based solutions to prevent and/or eliminate ice dams as well as general ice or snow accumulation at or about a gutter assembly. It should be noted that nylon hosiery represents or typifies a low cost material that may be used in construction of mesh casing 11 and provides an excellent mesh casing or meshed sheathing or other (ice-melting) chemical-delivery sheathing. In any event, it will be seen that mesh casing 11 is a net or net-like casing as generally depicted in FIGS. 1–2(*c*). Mesh is generally definable as the fabric of a net or a woven, knit, or knotted material of open texture with evenly spaced holes or a weblike pattern or construction. It is with these definitions in view that the term mesh casing 11 is used to define the subject matter of the present invention.

As will be seen from a general inspection of FIG. 3, net-like mesh casing 11 is preferably constructed of flexible fabric or is made to be flexible so as to enable a user to form at least one casing bend intermediate the casing length. This is a significant structure detail insofar as placement of each salt-delivery assembly 10 upon assembly-supporting surface 37 may often require the user to manipulate mesh casing 11 so as to more effectively place salt-delivery assembly 10 around corner mounted gutter trough portions 31 and the like.

Of particular interest in the current mesh casing application are environmentally degradable or biodegradable/compostable cotton-based nonwovens. Biodegradable/compostable cotton-based nonwovens are sustainable materials, and as such, there is increasing interest in them, with the expansion of nonwovens into novel applications. Over the past few years, research has been done at the University of Tennessee, Knoxville to produce and evaluate nonwoven products containing cotton with different thermoplastic binder fibers. Nonwoven fabrics manufactured from cotton and Eastar, a biodegradable thermoplastic fiber have shown great promise. For an interesting discussion of biodegradable thermoplastic fiber, the reader is directed to the publication entitled: Preparation and Properties of Cotton-Eastar Biodegradable/Compostable Nonwovens by Gajanan S. Bhat, Kermit Duckett & Haoming Rong, The University of Tennessee, Knoxville, Tenn. 37996.

Of further interest in the construction of mesh casing 11 is jute. Jute is 100 percent environmentally degradable or bio-degradable and thus, environment-friendly. It is used extensively in manufacturing different types of packaging material for agricultural and industrial products. Jute is available in abundance in India, at competitive prices. Jute is now not just a major textile fiber, but also a raw material for non-textile products, which help to protect environment, which is an integral part of any development planning. Known for its coarse character due to its heavy texture, jute has come to acquire the center stage as an eco-friendly alternative. Jute, characterized by its silky texture, high tensile strength and resistance to heat and fire is considered fit for use in industries as varied as fashion, travel and luggage, furnishings, carpets and floor coverings, decoratives, textiles and made-ups.

It is thus contemplated that mesh casing 11 be preferably constructed from environmentally degradable or biodegradable fabric comprising materials of the noted sort so as to have an inherent seasonal durability, the inherent seasonal durability for degrading mesh casing 11 when salt-based fill material 12 has decremented to substantially zero. In other words, it is contemplated that mesh casing 11 be designed to last through a single ice dam season or a single cold winter season in a given region and then fall apart or disintegrate in the spring time or warmer months so as to be self-cleaning. It is thus contemplated that a user could place a series of salt-delivery assemblies 10 in a gutter assemblage at the beginning of an ice dam season, allow the salt-delivery assemblies 10 to maintain an ice-free gutter assembly 30 and thus an ice-free roof edge for the duration of the ice dam or winter season and then disintegrate at the end of the ice dam or winter season so that users thereof do not have to revisit the roof edging for removal thereof.

Figure 8:
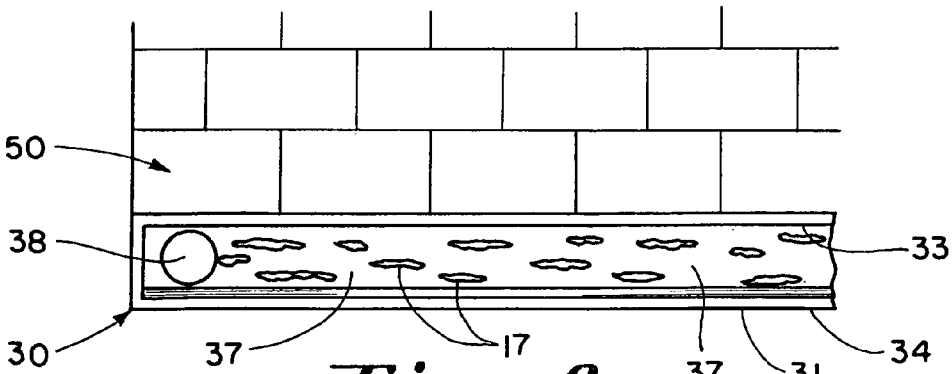
FIG. 8 is a fragmentary top plan view of a gutter-salt system depicting a self-destructed salt-delivery assembly upon the assembly-supporting surface of a gutter assembly affixed in adjacency to roof edging.

It is further contemplated that the degraded mesh casing as referenced at 17 in FIG. 8 is relatively non-resistant to the actions of flowing water and thus is readily movable by flowing water. Typically, ice melt and water flow are plentiful during the spring months, which further are typically characterized by plentiful rainfall. It is thus contemplated that flowing water may be plentiful during the post ice dam or post winter season and thus flowing water may readily move or wash the degraded mesh casing 17 from assembly-supporting surface 37 to matter outlet end 40 via matter outlet aperture 38, matter inlet end 39, and conduit length 41. As thus described, it is contemplated that degraded mesh casing 17 is environmentally-disposable or may otherwise be disposed of by moving water through the typical cleansing action of water moving through gutter assembly 30.

Figure 4:
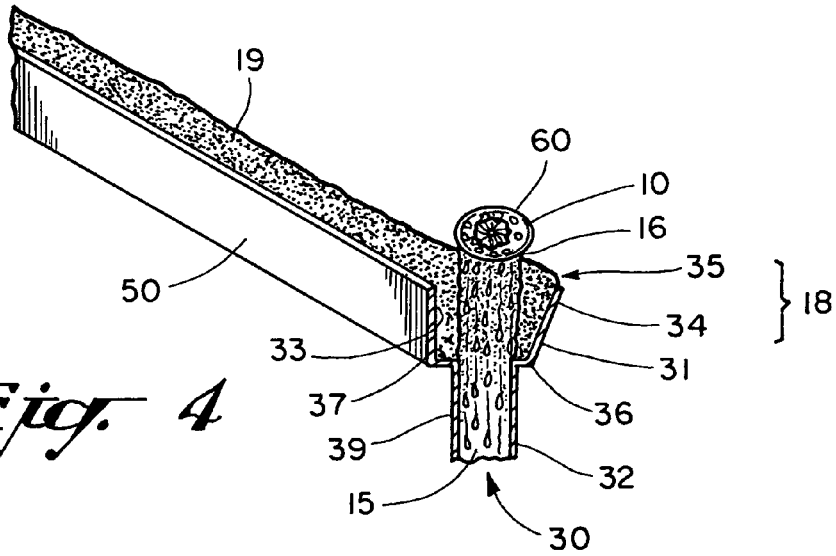
FIG. 4 is a fragmentary side view of the gutter-salt system depicting a salt-delivery assembly placed in a first ice dam elimination zone.
Figure 5:
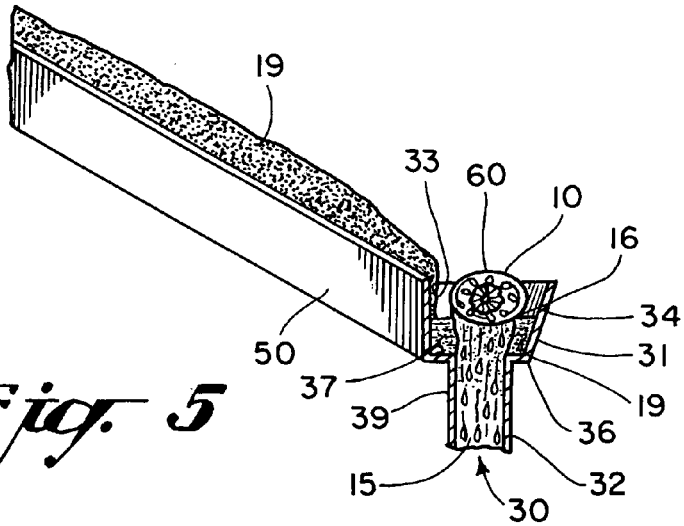
FIG. 5 is a fragmentary side view of a gutter-salt system depicting a salt-delivery assembly placed in a second ice dam elimination zone.

Mesh casing 11 preferably comprises an inner salt-retaining surface (not generally illustrated); an outer matter-engaging surface 13 as generally illustrated and referenced in FIGS. 2(*a*)–2(*c*); a casing thickness (not generally illustrated), a casing length as generally depicted in FIGS. 1–3; a substantially uniform casing diameter as generally depicted in FIGS. 3–6; a transverse casing periphery 60 as may be understood from an inspection of the end views of mesh casing 11 in FIGS. 4 and 5; and a plurality of mesh apertures (in other words, net-like apertures) as generally referenced at hatch markings 14 in FIGS. 2(*a*)–2(*c*). It will be understood that the casing thickness and the mesh apertures extend from the salt-retaining surface (or matter-retaining surface) to matter-engaging surface 13 about the entire casing periphery and along the entire casing length (the mesh casing being a net-like sheath). The mesh apertures each further inherently comprise a maximal aperture dimension. In other words, the size of each aperture in mesh casing 11 has at least one lineal dimension across the aperture opening that is of maximized magnitude relative to the remainder of each aperture opening. The mesh apertures each comprise a maximal aperture dimension on the order of up to about 5000 microns for preventing significantly sized salt-based fill material 12 to exit the apertures 14. It is believed that fill material 12 having maximal dimensions larger than about 5000 microns will be prevented from exiting mesh casing 11 and matter outlet end 40, thereby reducing the likelihood of causing unsightly salt or fill material 12 deposits adjacent assembly-supporting surface 37 or matter outlet end 40.

The solid, chemically-active, salt-based fill material 12 preferably comprises a series or plurality of salt pellets as can be generally seen from an inspection of FIGS. 1–2(*b*). It is contemplated that of all the chemically-active compounds that could be selected as a de-icing agent, the preferred fill material or compound comprise calcium chloride (i.e. (1) pure calcium chloride or (2) a mixture of calcium chloride with some suitable compound cooperatively associated with the calcium chloride ingredient). It is further contemplated that the fill material 12 may alternatively comprise a mixture of various salts such as those earlier noted.

Calcium chloride comes in many forms, including pellets and flakes. Pellets are the most effective delivery system for use in combination with the present invention. Calcium chloride occurs naturally as liquid brine. This is significant, since dry pellets of calcium chloride readily attract moisture and go into a solution as the calcium chloride tries to return to its natural liquid brine state. Calcium chloride pellets thus attract moisture to form brine, which, in turn, lowers the freezing point of the resulting water-based solution and melts snow and ice on contact at a salt-water interface. Calcium chloride is capable of lowering the freezing point of water to about −60° F. When calcium chloride pellets come into contact with snow or ice, they start an exothermic chemical reaction, which gives off heat, which heat energy transfer further functions to melt the snow and ice. Because of its exothermic properties, calcium chloride cuts through ice and snow more quickly than sodium chloride or magnesium chloride.

Calcium chloride's ability to attract moisture is one of the reasons why it is one of the fastest acting ice-melting compounds because it simply becomes brine faster, even in freezing temperatures, when it is unlikely to come into contact with free moisture. Calcium chloride actually brings moisture to itself by absorbing it from the atmosphere. Further, there is little or no residue or sediment since calcium chloride dissolves completely in water and thus will not operate to otherwise clog gutter assemblies. Further, calcium chloride is one of the least harmful de-icing salts in terms of its impact upon plant and animal life. Further still, calcium chloride is relatively non-corrosive to cement, paint, and metal (80–90% less corrosive than sodium chloride and 26 times less corrosive than rock salt on cement surfaces).

Notably, the preferable calcium chloride salt pellets of salt-based fill material 12 each inherently comprise a minimal pellet dimension. In other words, the size of each pellet or solid salt portion has at least one lineal dimension across the pellet that is of maximized magnitude relative to the remainder of the pellet structure. The minimal pellet dimension is preferably greater in magnitude than the maximal aperture dimension, and thus, salt-based fill material 12 is retained by the salt-retaining surface. It will be seen from a comparative inspection of FIGS. 2(*a*) and 2(*b*) versus FIG. 2(*c*) that salt-based fill material 12 may either comprise relatively large dimensioned pellets or salt portions (as depicted in FIGS. 2(*a*) and 2(*b*)) or may comprise relatively small dimensioned pellets or salt portions (as depicted in FIG. 2(*c*)).

In any event, the notion of retaining the pellets by a salt-retaining surface is akin to a mesh sack of marbles, the marbles being retained by inner surface of the sack, the apertures in the mesh sack being of sufficient size and shape to retain the marbles within the sack. Calcium chloride pellets are to be preferred over flaked calcium chloride in that pellets tend to bore through or melt snow and ice in a vertical manner whereas flakes tend to melt snow and ice in both horizontal and vertical directions. Since the primary goal in ice dam removal is a vertically-oriented melt, pellets are to be preferred. Further, flakes tend to give off less heat energy in the exothermic reactions it undergoes thus taking longer to melt comparatively similar quantities of ice and/or snow and thus decreasing its appeal for use in the present invention.

The mesh apertures, the casing thickness, and matter-engaging surface 13, however, allow water, whether in solid or liquid form, (the constituents of which are sized and shaped to easily pass through the mesh apertures) to contact salt-based fill material 12 at a salt-water interface 16 as generally depicted in FIGS. 1, 4, and 5. In this regard, it should be noted that each salt-delivery assembly 10 is designed for placement in superior adjacency to assembly-supporting surface 37 for allowing water to contact salt-based fill material 12, whether the water is located inferior to or superior to any given salt-delivery assembly 10. A portion of (or portions of) salt-based fill material 12 dissolve in the water when the water contacts salt-based fill material 12 and thus forms a flowable salt solution or water-based solution as depicted at 15 in FIGS. 1, and 4–7. Salt solution 15 inherently has a depressed freezing point for preventing ice formation as heretofore described. Salt-based fill material 12 is thus decremented by an amount substantially equal to the salt portion that dissolves in the water. The flowable salt solution 15 thus flows from salt-water interface 16 to assembly-supporting surface 37 to matter outlet end 40 via matter outlet aperture 38, matter inlet end 39, and conduit length 41. The salt solution 15 thus prevents ice formation and gutter-salt system 10, as thus specified, prevents ice dam formation at roof edging 50.

Figure 6:
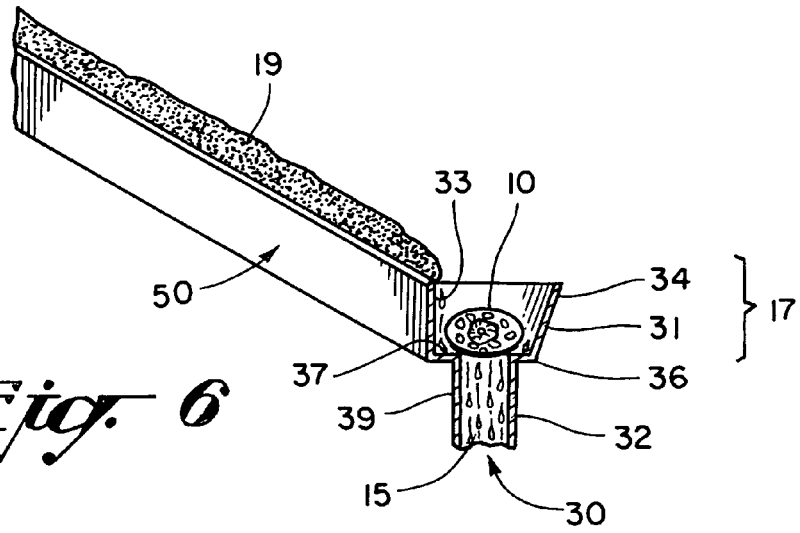
FIG. 6 is a fragmentary side view of a gutter-salt system depicting a salt-delivery assembly placed in an ice dam prevention zone.
Figure 7:
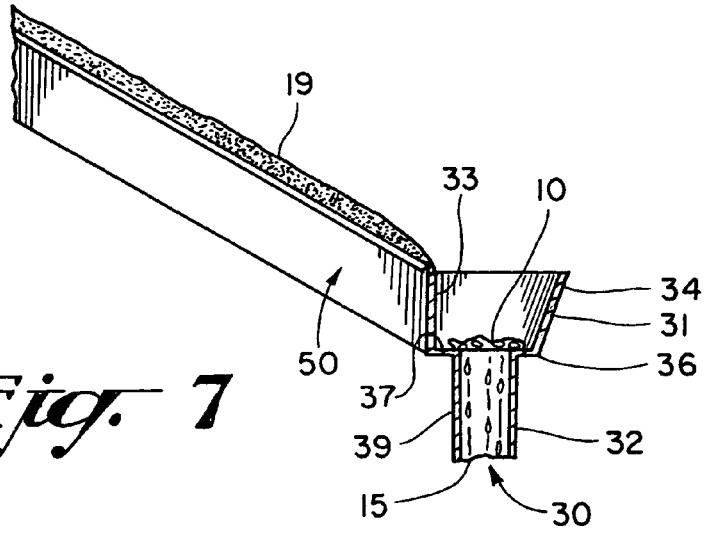
FIG. 7 is a fragmentary side view of a gutter-salt system depicting a salt-delivery assembly having salt-based fill material decremented to substantially zero.

As earlier alluded to, it is further contemplated that each salt-delivery assembly 10 may be placed in a select functional zone in superior adjacency to assembly-supporting surface 37, the select functional zone being selected from the group consisting of an ice dam prevention zone as generally depicted in FIGS. 1, 3, and as specifically referenced at 17 in FIG. 6; and an ice dam elimination zone as generally depicted in FIGS. 4 and 5 and as specifically referenced at 18 in FIG. 4. The ice dam prevention zone 17 may preferably be defined by those regions or zones in which salt-delivery assembly 10 is placed directly upon assembly-supporting surface 37 as generally shown in the noted figures. In other words, the ice dam prevention zone may be defined by that region extending intermediate the assembly-supporting surface 37 to the superior gutter end 35. The ice dam elimination zone 18 may preferably be defined by those regions or zones in which salt-delivery assembly 10 is placed directly upon an ice dam or ice formation in superior adjacency to superior gutter end 35, which ice dam or ice formation is formed directly upon assembly-supporting surface 37 as generally depicted in FIGS. 4 and 5. In other words, the ice dam elimination zone may be defined by that region extending upwardly from the superior surface of the ice/snow formation 19.

In other words, ice dam elimination zone 18 may be defined by placement of salt-delivery assembly 10 upon ice or snow 19 such that ice or snow 19 is primarily located in inferior adjacency to salt-delivery assembly 10. Alternatively, ice dam prevention zone 17 may be defined by placement of salt-delivery assembly 10 directly upon assembly-supporting surface 37 such that ice or snow 19 coming into contact with the superior regions of salt-delivery assembly 10 will form flowable salt solution 15 as earlier described and thus the formation of an ice dam or ice in superior adjacency to the placed salt-delivery assembly 10 will be prevented. This latter notion (the prevention of ice dam formation) is generally depicted in FIG. 1. In this regard, it is further contemplated that the casing diameter or maximal cross-sectional width is substantially equal to or less than the assembly-supporting width so as to provide an ice or snow contact area that may extend from rear wall 33 to forward wall 34 for more effective prevention and/or elimination of ice formation.

While the above description contains much specificity, this specificity should not be construed as limitations on the scope of the invention, but rather as an exemplification of the invention. For example, while the salt or chemical-delivery assembly or apparatus necessarily involves its use in combination with a gutter assembly, it is contemplated that the chemical-delivery assembly is inventive in its own right. Thus, it is contemplated that the present invention provides a chemical-delivery assembly for removing ice at a roof edge, the chemical-delivery assembly comprising a mesh casing and solid, chemically-active fill material.

The mesh casing essentially comprises an inner matter-retaining or material-retaining surface, an outer matter-engaging surface, and a plurality of mesh apertures. The mesh apertures extend from the material-retaining surface to the matter-engaging surface and each comprises a maximal aperture dimension. The chemically-active fill material comprises a plurality of pellets. Each pellet comprises a minimal pellet dimension, the minimal pellet dimension being greater in magnitude than the maximal aperture dimension. The maximal aperture dimension thus being designed for retaining the chemically-active fill material within the mesh casing behind the material-retaining surface.

As earlier noted, the chemical-delivery apparatus is designed to be placed in superior adjacency to the assembly-supporting surface. The mesh apertures and the matter-engaging surface allow water to contact the chemically-active fill material at a chemical-water interface and a material portion of the chemically-active fill material is thus solubly associated with the water when contacted by water. The chemically-active fill material thus forms a flowable water-based solution having a depressed freezing point for preventing ice formation. Notably, the chemically-active fill material is continually decremented by an amount substantially equal to the material portion and the flowable water-based solution flows from the chemical-water interface to the assembly-supporting surface to the matter outlet end via the matter outlet aperture, the matter inlet end, and the conduit length. The water-based solution thus prevents ice formation and the chemical-delivery apparatus thus removes ice at the roof edge.

Accordingly, although the invention has been described by reference to a preferred embodiment with certain spatially descriptive language and the like, it is not intended that the novel assembly or apparatus be limited thereby, but that modifications thereof are intended to be included as falling within the broad scope and spirit of the foregoing disclosure, the following claims and the appended drawings.

I claim:

1. A gutter-salt system for preventing ice dam formation at a roof edging, the gutter-salt system comprising, in combination:

a gutter assembly for attachment in adjacency to roof edging, the gutter assembly comprising a gutter trough portion and at least one downspout portion, the gutter trough portion comprising a rear wall, a forward wall, a superior gutter end, and an inferior gutter end, the inferior gutter end comprising a substantially planar assembly-supporting surface and at least one water outlet aperture, the assembly-supporting surface extending from the rear wall to the forward wall, the assembly-supporting surface thus having an assembly-supporting width, the downspout portion comprising a matter inlet end, a matter outlet end, and a conduit length intermediate the matter inlet end and the matter outlet end, the matter inlet end being cooperatively associated with the matter outlet aperture for channeling matter from the assembly-supporting surface to the matter outlet end via the conduit length; and a plurality of salt-delivery assemblies, each salt-delivery assembly for placement in superior adjacency to the assembly-supporting surface comprising a substantially tubular mesh casing and solid, salt-based fill material, the mesh casing comprising an inner salt-retaining surface, an outer matter-engaging surface, a casing thickness, a casing length, a substantially uniform casing diameter, a transverse casing periphery, and a plurality of mesh apertures, the casing thickness and the mesh apertures extending from the salt-retaining surface to the matter-engaging surface in side-by-side relation about the entire casing periphery and along the entire casing length, the mesh apertures each comprising a maximal aperture dimension, the salt-based fill material comprising a plurality of salt pellets, the salt pellets each comprising a minimal pellet dimension, the minimal pellet dimension being greater in magnitude than the maximal aperture dimension, the salt-based fill material thus being retained by the salt-retaining surface, the mesh apertures, the casing thickness, and the matter-engaging surface allowing water to contact the salt-based fill material at a salt-water interface, a salt portion of the salt-based fill material dissolving in water when water contacts the salt-based fill material thus forming a flowable salt solution, the salt solution having a depressed freezing point, the depressed freezing point for preventing ice formation, the salt-based fill material being decremented by an amount substantially equal to the salt portion, the flowable salt solution flowing from the salt-water interface to the assembly-supporting surface to the matter outlet end via the matter outlet aperture, the matter inlet end, and the conduit length, the salt solution thus preventing ice formation, and the gutter-salt system thus preventing ice dam formation at the roof edging.

2. The gutter-salt system of claim 1 wherein the mesh casing is constructed from water permeable, environmentally degradable fabric, the environmentally degradable fabric having inherent seasonal durability, the inherent seasonal durability for degrading the mesh casing when the salt-based fill material has decremented to substantially zero, the degraded mesh casing being movable by flowing water, flowing water thus moving the self-destructed mesh casing from the assembly-supporting surface to the matter outlet end via the matter outlet aperture, the matter inlet end, and the conduit length, the degraded mesh casing thus being environmentally-disposable.

3. The gutter-salt system of claim 2 wherein each salt-delivery assembly is placed in a select functional zone in superior adjacency to the assembly-supporting surface, the select functional zone being selected from the group consisting of an ice dam prevention zone and an ice dam elimination zone, the ice dam prevention zone being defined by a region extending intermediate the assembly-supporting surface and the superior gutter end, the ice dam elimination zone being defined by a region extending upwardly from an ice/snow formation, the ice/snow formation being formed in the region extending intermediate the assembly-supporting surface and the superior gutter end.

4. The gutter-salt system of claim 3 wherein the casing diameter is substantially equal to or less than the assembly-supporting width.

5. The gutter-salt system of claim 4 wherein the maximal aperture dimension ranges from 0 to about 5000 microns for preventing deposition of fill material adjacent the matter outlet end.

6. The gutter-salt system of claim 5 wherein the salt-based fill material comprises calcium chloride.

7. The gutter-salt system of claim 6 wherein the mesh casing is flexible for enabling a user to form at least one casing bend intermediate the casing length.

8. A system for removing ice from a roof edge, the system comprising, in combination:

a gutter assembly, the gutter assembly being attached adjacent the roof edge comprising a gutter trough portion and at least one downspout portion, the gutter trough portion comprising a rear wall, a forward wall, and an inferior gutter end, the inferior gutter end comprising an assembly-supporting surface and at least one water outlet aperture, the downspout portion comprising a matter inlet end, a matter outlet end, and a conduit length intermediate the matter inlet end and the matter outlet end, the matter inlet end being cooperatively associated with the matter outlet aperture for channeling matter from the assembly-supporting surface to the matter outlet end via the conduit length; and at least one chemical-delivery assembly, the chemical-delivery assembly for placement in superior adjacency to the assembly-supporting surface comprising a mesh casing and solid, chemically-active fill material, the mesh casing comprising an inner material-retaining surface, an outer matter-engaging surface, a casing length, a transverse casing periphery, and a plurality of mesh apertures, the mesh apertures extending from the material-retaining surface to the matter-engaging surface in side-by-side relation about the entire casing periphery and along the entire casing length, the mesh apertures each comprising a maximal aperture dimension, the chemically-active fill material comprising a plurality of pellets, the pellets each comprising a minimal pellet dimension, the minimal pellet dimension being greater in magnitude than the maximal aperture dimension, the chemically-active fill material thus being retained by the material-retaining surface, the mesh apertures and the matter-engaging surface allowing water to contact the chemically-active fill material at a chemical-water interface, a material portion of the chemically-active fill material being released from at least one pellet when water contacts the chemically-active fill material at a chemical-water interface thus forming a flowable water-based solution, the water-based solution having a depressed freezing point, the depressed freezing point for preventing ice formation, the chemically-active fill material being decremented by an amount substantially equal to the material portion, the flowable water-based solution flowing from the chemical-water interface to the assembly-supporting surface to the matter outlet end via the matter outlet aperture, the matter inlet end, and the conduit length, the water-based solution thus preventing ice formation, the system thus for removing ice from the roof edge.

9. The system of claim 8 wherein the mesh casing is constructed from water-permeable, environmentally degradable fabric, the environmentally degradable fabric having inherent seasonal durability, the inherent seasonal durability for degrading the mesh casing when the chemically-active fill material has decremented to substantially zero, the degraded mesh casing being movable by flowing water, flowing water thus moving the degraded mesh casing from the assembly-supporting surface to the matter outlet end via the matter outlet aperture, the matter inlet end, and the conduit length, the degraded mesh casing thus being environmentally-disposable.

10. The system of claim 9 wherein the chemical-delivery assembly is placed in a select functional zone in superior adjacency to the assembly-supporting surface, the select functional zone being selected from the group consisting of an ice prevention zone and an ice elimination zone, the ice prevention zone being defined by a region extending intermediate the assembly-supporting surface and the superior gutter end, the ice elimination zone being defined by a region extending upwardly from an ice/snow formation, the ice/snow formation being formed in the region extending intermediate the assembly-supporting surface and the superior gutter end.

11. The system of claim 9 wherein the assembly-supporting surface extends from the rear wall to the forward wall, the assembly-supporting surface thus having an assembly-supporting width, the mesh casing comprising a maximal cross-sectional width, the cross-sectional width being substantially equal to or less than the assembly-supporting width.

12. The system of claim 9 wherein the maximal aperture dimension ranges from 0 to about 5000 microns for preventing deposition of fill material adjacent the matter outlet end.

13. The system of claim 9 wherein the chemically-active fill material comprises a salt-based fill material.

14. The system of claim 13 wherein the salt-based fill material comprises calcium chloride.

15. The system of claim 9 wherein the mesh casing is flexible for enabling a user to form at least one casing bend intermediate the casing length.

* * * * *